US006648762B2

(12) United States Patent
Walker et al.

(10) Patent No.: US 6,648,762 B2
(45) Date of Patent: Nov. 18, 2003

(54) ELECTRONIC AMUSEMENT DEVICE AND METHOD FOR PROPAGATING A PERFORMANCE ADJUSTMENT SIGNAL

(75) Inventors: Jay S. Walker, Ridgefield, CT (US); James A. Jorasch, Stamford, CT (US); Magdalena Mik, Greenwich, CT (US); Robert R. Lech, Norwalk, CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

(21) Appl. No.: 10/007,874

(22) Filed: Nov. 12, 2001

(65) Prior Publication Data

US 2002/0042295 A1 Apr. 11, 2002

Related U.S. Application Data

(63) Continuation of application No. 09/157,232, filed on Sep. 18, 1998, now Pat. No. 6,328,648.

(51) Int. Cl.[7] ..... A63F 9/24
(52) U.S. Cl. ..... 463/25
(58) Field of Search ..... 463/16, 20, 25, 463/26, 27, 28

(56) References Cited

U.S. PATENT DOCUMENTS

| | | | | |
|---|---|---|---|---|
| 4,636,951 | A | 1/1987 | Harlick | 364/412 |
| 4,837,728 | A | 6/1989 | Barrie et al. | 364/412 |
| 5,116,055 | A | 5/1992 | Tracy | 273/138 A |
| 5,123,649 | A | 6/1992 | Tiberio | 273/143 R |
| 5,127,651 | A | 7/1992 | Okada | 273/143 R |
| 5,280,909 | A | 1/1994 | Tracy | 273/138 A |
| 5,409,225 | A | 4/1995 | Kelly et al. | 273/138 R |
| 5,564,700 | A | 10/1996 | Celona | 463/27 |
| 5,580,309 | A | 12/1996 | Piechowiak et al. | 463/16 |
| 5,611,730 | A | 3/1997 | Weiss | 463/20 |
| 5,766,076 | A | 6/1998 | Pease et al. | 463/27 |
| 5,797,794 | A | 8/1998 | Angell | 463/18 |
| 5,876,284 | A | 3/1999 | Acres et al. | 463/25 |
| 6,033,307 | A | 3/2000 | Vancura | 463/20 |
| 6,039,648 | A | 3/2000 | Guinn et al. | 463/16 |
| 6,068,552 | A | 5/2000 | Walker et al. | 463/21 |
| 6,077,162 | A | 6/2000 | Weiss | 463/26 |
| 6,217,448 | B1 | 4/2001 | Olsen | 463/25 |

OTHER PUBLICATIONS

Berry, Kathleen M., "All About/Gambling Equipment; Hardware Makers Cash In On America's Betting Mania", The New York Times, Sep. 16, 1990, Section 3, p. 4, Col. 1, Financial Desk.

Grochowski, John, "Players Look for Edge With Casino Gimmicks", Chicago Sun–Times, Aug. 25, 1995, Section: Weekend Plus, Gaming, p. 15, NC.

Press Release: "Mikohn to Install First Moneytime™ Slot Bonus Jackpot System at an Indian Gaming Site With Two Years Lease Contract For New Mexico Casino", The Foley Company, Dec. 17, 1997.

Website: "Megajackpots", International Game Technology Company Profile, (http //igtgame com/company/profile2 html), download date: May 13, 1998.

Website: "A New Era in Gaming", Acres Gaming Products, (http // www acresgaming com/products htm), download date: May 26, 1998.

*Primary Examiner*—Michael O'Neill
(74) *Attorney, Agent, or Firm*—Magdalena M. Fincham

(57) ABSTRACT

An electronic amusement device and a method for operating the device are disclosed. In accordance with one embodiment, a slot machine receives an initiation signal to initiate game play at the slot machine. The slot machine conducts a game in response to the initiation signal. The slot machine determines whether a propagation criteria has been achieved and outputs a propagation signal, indicating a performance adjustment, to at least one other slot machine. In accordance with a second embodiment, a slot machine that stores a performance level is disclosed. The slot machine receives a propagation signal indicating a performance adjustment, and the slot machine adjusts the performance level accordingly. A slot server and method for operating the server are also disclosed.

18 Claims, 17 Drawing Sheets

400

450

| SOURCE GAMING DEVICE IDENTIFIER 410 | RECIPIENT GAMING DEVICE IDENTIFIER 1 412 | RECIPIENT GAMING DEVICE IDENTIFIER 2 414 |
|---|---|---|
| 987652 | 987653 | N/A |
| 987653 | 987652 | 987654 |
| 987654 | 987653 | 136912 |
| 136912 | 987654 | 481216 |
| 481216 | 136912 | N/A |

FIG. 4

500

| GAMING DEVICE IDENTIFIER 510 | PERFORMANCE LEVEL 512 |
|---|---|
| 987654 | 2 |
| 136912 | 1 |
| 481216 | 1 |
| 987652 | 2 |
| 987653 | 3 |

FIG. 5

ELECTRONIC AMUSEMENT DEVICE AND METHOD FOR PROPAGATING A PERFORMANCE ADJUSTMENT SIGNAL

CROSS-REFERENCE TO RELATED APPLICATIONS

The present application is a continuation of application Ser. No. 09/157,232, filed Sep. 18, 1998, now U.S. Pat. No. 6,328,648 for "ELECTRONIC AMUSEMENT DEVICE AND METHOD FOR PROPAGATING A PERFORMANCE ADJUSTMENT SIGNAL".

BACKGROUND OF THE INVENTION

1. Field of the Invention

The present invention relates to an electronic amusement device and more particularly to an electronic amusement device such as a slot machine having the ability to propagate an indication of performance adjustment.

2. Description of the Related Art

In 1997, electronic amusement devices (including slot machines, video poker machines and the like, hereinafter referred to as "slot machines" or "machines") installed in U.S. casinos generated greater than ten billion dollars of revenue. With individual machines typically earning between $50 and $150 per day, slot machines can account for well over 50% of a U.S. casino's overall profits. The net profit from slot machine play for a casino generally exceeds the profit from all other casino gaming activities.

The comparatively high profitability of slot machines may be attributed to many factors, such as the low operating cost of slot machines compared to table games, the ability of slot machines to conduct games at a faster play rate compared to table games, the appeal of slot machines to players of every skill level, and the large potential payout offered by slot machines in exchange for a comparatively small wager.

To capitalize on the comparatively high profitability of slot machines, many casinos provide thousands of machines for players to use. Consequently, players are often faced with an overwhelming variety of slot machines, producing a cacophony of sights and sounds, which makes selecting a slot machine confusing.

When faced with a wide variety of slot machines, many players try to determine which machine or which area within the casino is "lucky" or "hot". A lucky or hot machine is a machine that a player believes will payout more frequently or in larger amounts compared to other slot machines. Players often consider a machine lucky or hot if it has recently awarded a large jackpot, provides frequent payouts, or has not paid off recently and is therefore "due" to payout. Unfortunately, players presently have no way to readily identify such machines. Some prior art slot machines display a pay-back percentage, but this represents long-term results, not whether a machine could be deemed to be lucky or hot at a particular moment.

U.S. Pat. No. 5,127,651 describes a slot machine invented by Okada. The disclosed slot machine accumulates values bet on games during an insurance period. When the accumulated value reaches a predetermined amount, a predetermined value of insurance is paid out, and the insurance period is terminated. The disclosed slot machine displays the value having been wagered during the insurance period, allowing the player to consider or expect the payment of insurance when playing games, in addition to the winning of prizes. The Okada device has significant short comings. Although the Okada device displays the number of coins bet during an insurance period, it fails to provide a player with an indication of whether the machine could b considered lucky or hot.

It is not only difficult for slot machine players to determine whether a machine is lucky or hot, but slot machine players also have few ways to capitalize on the good fortune of those around them. Although one slot machine may be considered lucky or hot, the play of surrounding slot machines remains unaffected.

U.S. Pat. No. 5,564,700 to Celona, entitled "Proportional Payout Method for Progressively Linked Gaming Machines" describes a device that is intended to enable slot machine players to capitalize on the good fortune of those around them. The device proportionally pays out a progressive jackpot win to all of the players at a group of linked slot machines contributing to the progressive jackpot when a player playing at one of these linked slot machines hits the progressive jackpot winning combination.

U.S. Pat. No. 5,580,309 to Piechowiak et al., entitled "Linked Gaming Machines Having a Common Feature Controller", describes a system of linked slot machines. A central controller polls each linked machine for its results. After a certain criterion is met by one of the machines, a feature is enabled for all of the linked machines. The feature is disabled after a linked machine generates a winning game result based on the feature.

The Celona and Piechowiak systems enable players to benefit from the good fortune of others only in specific and limited ways. Accordingly, there is a need to provide a method and apparatus that propagates incremental adjustments in performance from a source gaming device to surrounding recipient gaming devices. It would further be advantageous to provide a method and apparatus that enables slot machine players to easily distinguish between slot machines having a variety of performance levels.

SUMMARY OF THE INVENTION

An object of the present invention is to provide a method and apparatus enabling slot machine players to easily determine whether a slot machine is desirable. A further object of the present invention is to provide a slot machine that adjusts its performance based on a level determined, in part, based upon the performance of at least one other slot machine. An advantage of the present invention for a casino operator is that it attracts the attention of potential slot machine players. Another advantage of the present invention for a casino operator is that it encourages prolonged slot machine play by players using the device.

In accordance with a first aspect of the present invention, an electronic amusement device and method is disclosed for propagating an indication of adjusted performance to at least one other slot machine. The method includes the steps of receiving an initiation signal to initiate a game play and conducting the game play in response to the initiation signal. The method also includes the step of determining whether a propagation criterion has been achieved. If the propagation criterion has been achieved, a propagation signal is output to at least one other slot machine. The propagation signal represents an instruction to adjust performance. The disclosed slot machine implements the method of the present invention.

In accordance with a second aspect of the present invention, a slot server and method is disclosed for communicating an indication of adjusted performance between at least two slot machines. The method includes the step of receiving game data from a source slot machine. The game data includes a source machine identifier corresponding to the source slot machine. The method also includes the step of determining whether a propagation criterion has been achieved by the source slot machine. If the propagation criterion has been achieved, at least one recipient machine identifier is determined. Each of the recipient machine identifiers corresponds to a recipient slot machine. The method further includes the step of transmitting a propagation signal to each recipient slot machine corresponding to the recipient machine identifiers.

In accordance with a third aspect of the present invention, an electronic amusement device and method is disclosed for processing an indication of adjusted performance. The method includes the step of storing a performance level. The method also includes receiving a propagation signal. The propagation signal represents an indication of adjusted performance. The method further includes the step of adjusting the performance level. Preferably, a visual representation of the performance level is output to alert players of the performance adjustment and to attract them to the gaming device with the increased performance level.

BRIEF DESCRIPTION OF THE DRAWING

These and other objects, features and advantages f the invention will be understood from a consideration of the following description of the invention, in which:

FIG. 4 is a table showing components of the propagation table of FIG. 3;

FIG. 5 is a table showing components of the status table of FIG. 3;

DETAILED DESCRIPTION OF THE INVENTION

By enabling slot players to benefit from the good fortune of neighboring players, casino operators can encourage a greater number of players to play slot machines. By also indicating which slot machines may be lucky or hot, or which machines have an increased performance level, casino operators can encourage players to utilize slot machines neighboring the hot slot machines.

The present invention is directed to a method and apparatus for determining whether a source slot machine has achieved a predetermined propagation criterion and for propagating a performance adjustment signal to at least one recipient slot machine associated with the source slot machine. Consequently, the present invention enables a slot machine to determine and indicate when it is "hot". The present invention further propagates the "luck" of a machine to neighboring machines. The present invention ensures that the indication of luck is accurate by adjusting the performance of the machine to provide more frequent payouts or larger payouts than a machine which operates at a base performance level. The performance of a slot machine consistent with the present invention is dictated by an associated performance level. As described with reference to the drawings, the preferred embodiment of the invention utilizes the performance level to determine an appropriate payout table. Of course, other factors may be utilized to adjust the performance of a slot machine, such as providing more favorable probability tables, enabling lower or higher wager amounts, and activating certain bonuses.

The preferred embodiment will be further described with reference to a client-server architecture in which much of the processing is performed by the source slot machine, and an alternate embodiment will be described with reference to a client-server architecture in which much of the processing is performed by the slot server. Of course, one skilled in the art will recognize various alternate embodiments that are consistent with the spirit and scope of the present invention.

Apparatus Architecture

Figure 1:
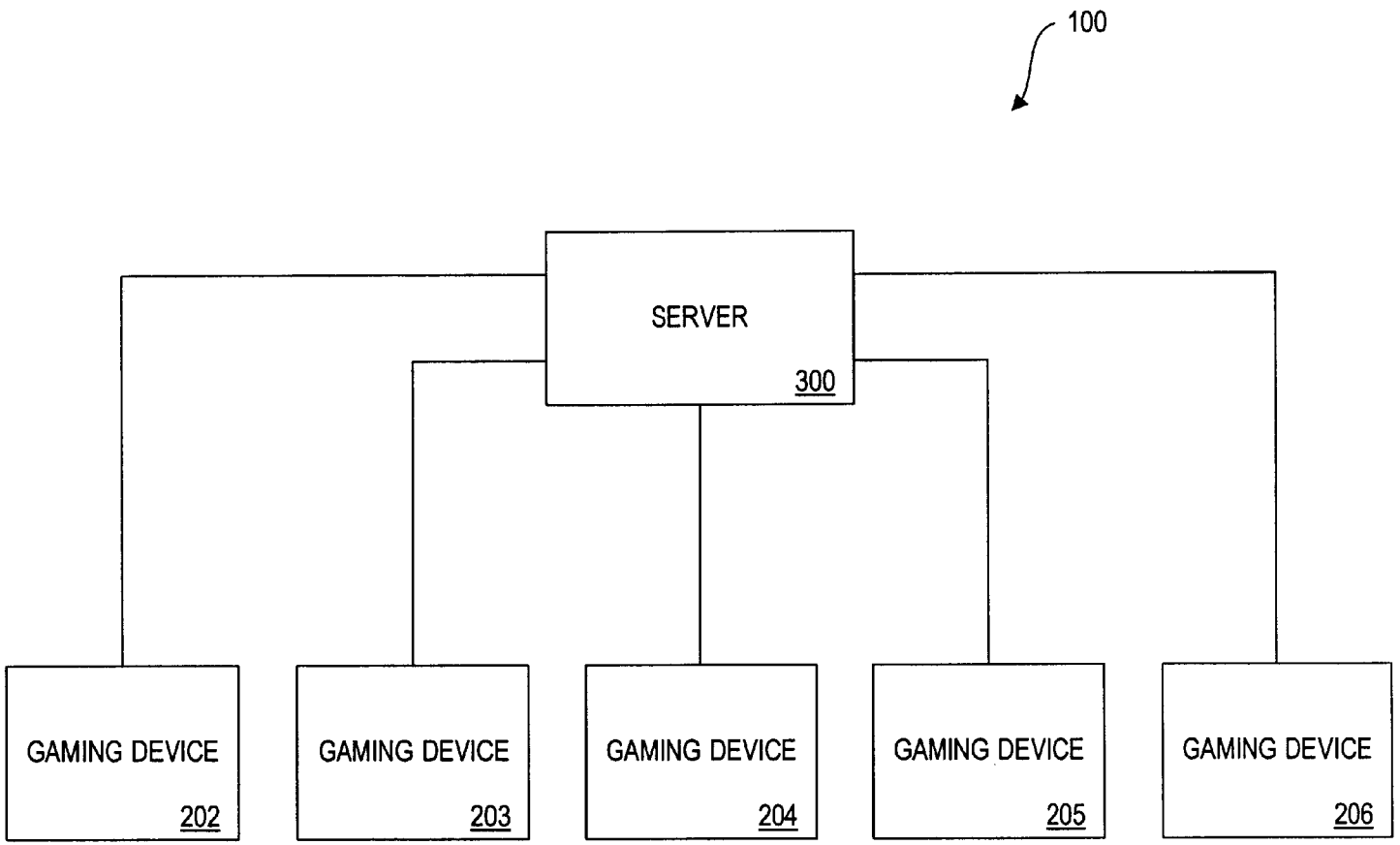
FIG. 1 is a block diagram illustrating a system for implementing the present invention.

The apparatus architecture of an exemplary embodiment of the present invention will now be discussed with reference to FIGS. 1–3. Referring to FIG. 1, there is shown a block diagram of a slot network 100. Network 100 includes a slot machine server 300 (hereinafter referred to as "server") that is linked to and communicates with networked gaming devices or slot machines 202, 203, 204, 205 and 206. Although five gaming devices are shown, a person of ordinary skill in the art will appreciate that any number of networked gaming devices could be linked to and in communication with server 300.

In the exemplary embodiment, a player employs a networked slot machine, such as slot machine 204, to play a game of chance. Upon slot machine 204 achieving a predetermined propagation criterion, recipient slot machines 203 and 205 are identified as being associated with slot machine 204. The association may be based on, for example, physical proximity of one gaming device to another or the type of each gaming device, or both.

Server 300 is directed to transmit a signal to the recipient slot machines 203 and 205. The signal, hereinafter referred to as a propagation signal or performance adjustment signal, represents a request to adjust the performance of recipient slot machines 203 and 205.

The predetermined propagation criterion may be indicative of either positive or negative performance of slot machine 204. Preferably, the control logic for determining whether slot machine 204 achieves the predetermined propagation criterion is processed locally by slot machine 204, in an alternate embodiment, such control logic may be processed by server 300. In the alternate embodiment, the performance adjustment signal is also transmitted to slot machine 204.

Slot machines 203, 204 and 205 adjust their performance in accordance with the transmitted performance adjustment signal. In this way, the performance of source slot machine 204 is propagated to associated recipient slot machines 203 and 205.

Although communication of the performance adjustment signal is described herein as being generated by server 300, slot network 100 could be a peer-to-peer network that does not require a server. Further, the communication of the performance adjustment signal may take place over an electrical connection, a fiber optic connection, via radio-frequency (RF) signals, or any other communication medium known by those skilled in the art.

Figure 2:
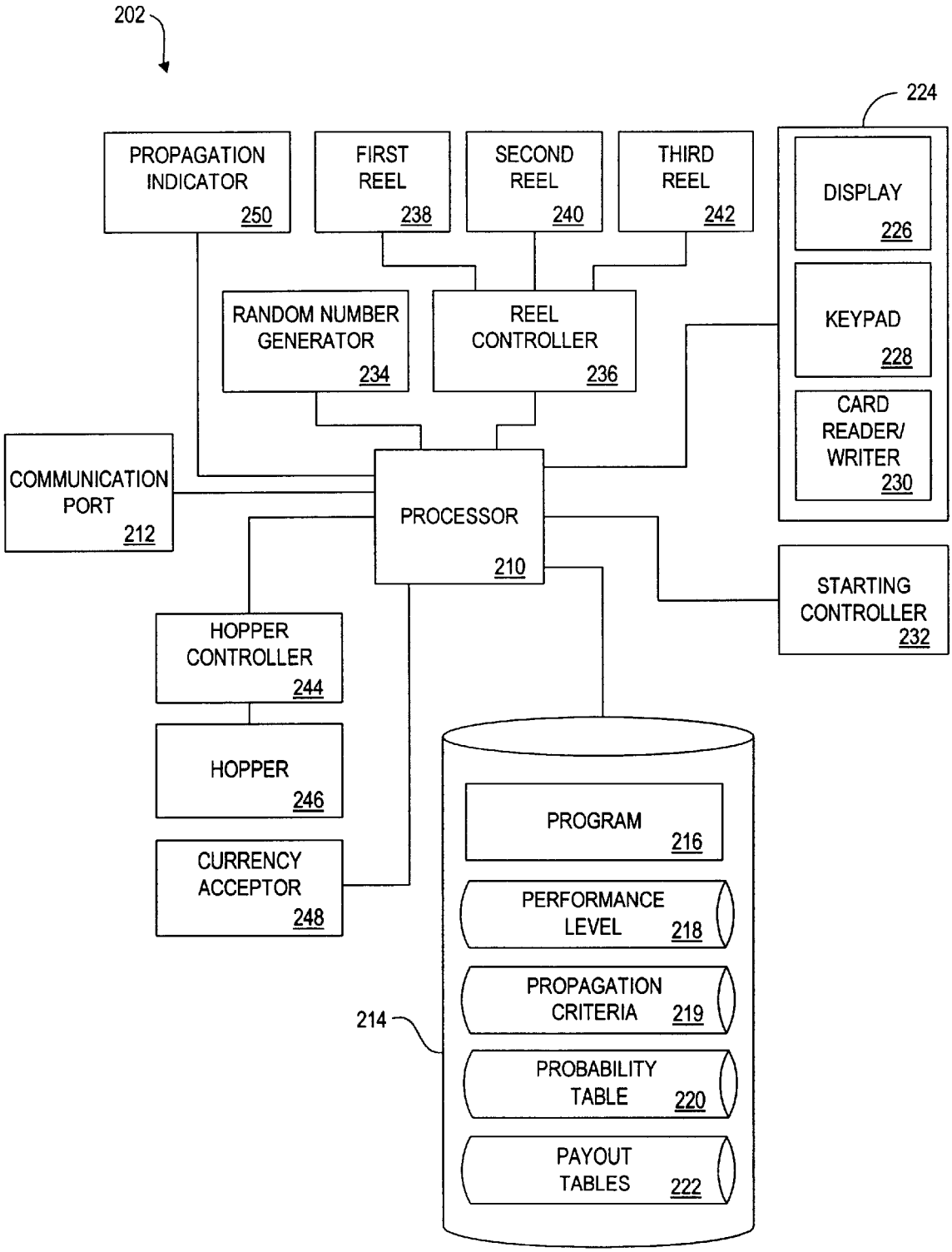
FIG. 2 is a block diagram of an electronic gaming device constructed in accordance with the present invention.

Referring now to FIG. 2, the architecture of slot machine 202 is illustrated. Slot machine 202, which is substantially similar to slot machines 203, 204, 205 and 206, is controlled by processor 210 and communicates with slot server 300 via communication port 212. Processor 210 is connected to storage device 214 which stores program instructions and data for operating slot machine 202 in accordance with the present invention. Specifically, storage device 214 stores program 216, performance level 218, propagation criteria 219, probability table 220 and payout tables 222. In the preferred embodiment, program 216 includes instructions for conducting a game of chance and instructions for implementing the method of causing a performance adjustment signal to be propagated, as described more completely with reference to FIG. 6.

Further connected to processor 210 are a player card tracking device 224, a random number generator 234, a reel controller 236 for controlling reels 238, 240 and 242, a hopper controller 244 having an associated hopper 246, a currency acceptor 248 and a propagation indicator 250.

As illustrated, slot machine 202 comprises many conventional components. The non-conventional components of slot machine 202 include the program instructions and data stored in storage device 214 and the propagation indicator 250. For purposes of better illustrating the invention, conventional components, well known to those skilled in the art, are described only briefly. Although the present embodiment of the invention is described as implemented with physical components, the invention applies equally well to and includes software embodiments such as would be implemented on the Internet and other computer data networks.

Processor 210 may be embodied as one or more well known processing units, for example a Pentium class CPU manufactured by Intel Corp. Data storage device 214 comprises an appropriate combination of magnetic and optical memory, such as disk drive memory, and semiconductor memory such as random access memory and read only memory. In addition to the program instructions and data shown in FIG. 2, storage device 214 stores appropriate operating system and control software (not shown), functional to operate gaming device 202 in the manner described below. Random number generator 234 comprises one of many well known random or pseudo-random number generators suitable for use in a gaming device.

Currency acceptor 248 is operative to receive one or more coins or bills, and to transmit an appropriate value signal to processor 210. Hopper controller 244, and hopper 246 connected thereto, are operative under the control of processor 210 to dispense coins to a player. Starting controller 232 comprises a player-operated device such as a handle or button for initiating the play of a game.

Player card tracking device 224 comprises a player tracking interface including a card reader/writer 230 for receiving a player tracking card (not shown), a display 226 for communicating messages to the player, and a keypad 228 for receiving player input such as a player identifier.

Figure 3:
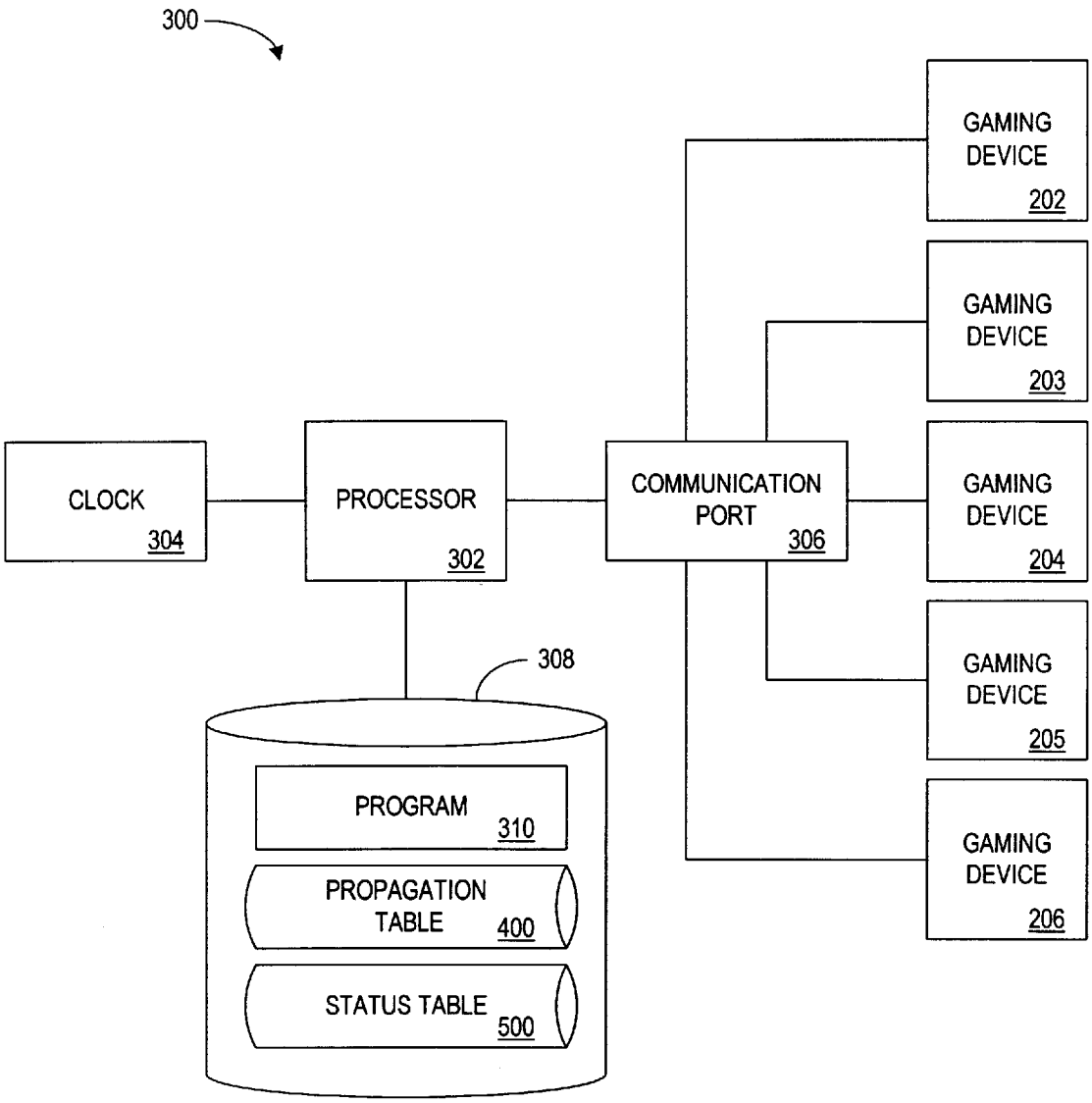
FIG. 3 is a block diagram of a slot server constructed in accordance with the present invention.

Referring now to FIG. 3, the architecture of slot server 300 is illustrated. In addition to conventional server components, slot server 300 includes a processor 302 linked to a clock 304, a storage device 308 and a communication port 306. Communication port 306 enables server 300 to communicate with gaming devices 202, 203, 204, 205 and 206. Storage device 308 comprises an appropriate combination of magnetic and optical memory, such as disk drive memory, and semiconductor memory such as random access memory and read only memory, and contains program 310 for controlling server 300 in accordance with the present invention.

According to the preferred embodiment, program 310 includes instructions for receiving a performance adjustment signal from a source slot machine, identifying at least one recipient slot machine corresponding to the source slot machine and propagating the performance adjustment to the recipient slot machines. In an alternate embodiment, program 310 may also include instructions for determining whether a source slot machine has achieved a predetermined propagation criterion. Storage device 308 further includes relevant data, including propagation table 400 and status table 500. In the alternate embodiment, in which processing is centralized at storage device 308, storage device 308 may also include propagation criteria 219 (see FIG. 2).

Data Tables

Referring now to FIG. 4, there are illustrated five representative records of an exemplary propagation table 400. Each record of propagation table 400 defines the relationship between a source gaming device and associated recipient gaming devices. According to the described embodiments of the present invention, propagation table 400 is used to determine the recipient slot machines to which a performance adjustment signal should be propagated.

Each record of propagation table 400 includes a source gaming device identifier 410 that uniquely identifies the record and corresponds to a source gaming device. Each record of propagation table 400 further includes two recipient gaming device identifier fields 412 and 414. Recipient gaming device identifier fields 412 and 414 indicate the recipient slot machines that are associated with the source gaming device identified by source gaming device identifier field 410.

For example, record 450, corresponds to a source slot machine having a gaming device identifier of "987653". Fields 412 and 414 of record 450 identify the recipient slot machines associated with the source slot machine. Slot machines having gaming device identifiers "987652" and "987654" are defined as associated with the slot machine having gaming device identifier "987653". While the illustrated embodiment utilizes only two recipient gaming device identifiers, other embodiments are envisioned in which greater or fewer recipient gaming device identifiers may be utilized.

Referring now to FIG. 5, there is depicted an exemplary status table 500. Each record of status table 500 defines the performance level of a networked gaming device. Status table 500 is not strictly necessary for the proper operation of the present invention, because the performance level associated with each networked gaming device may be stored locally at the gaming device. Status table 500, however, may be preferable, particularly in embodiments employing centralized processing.

Description of the Operation

Figure 6A:
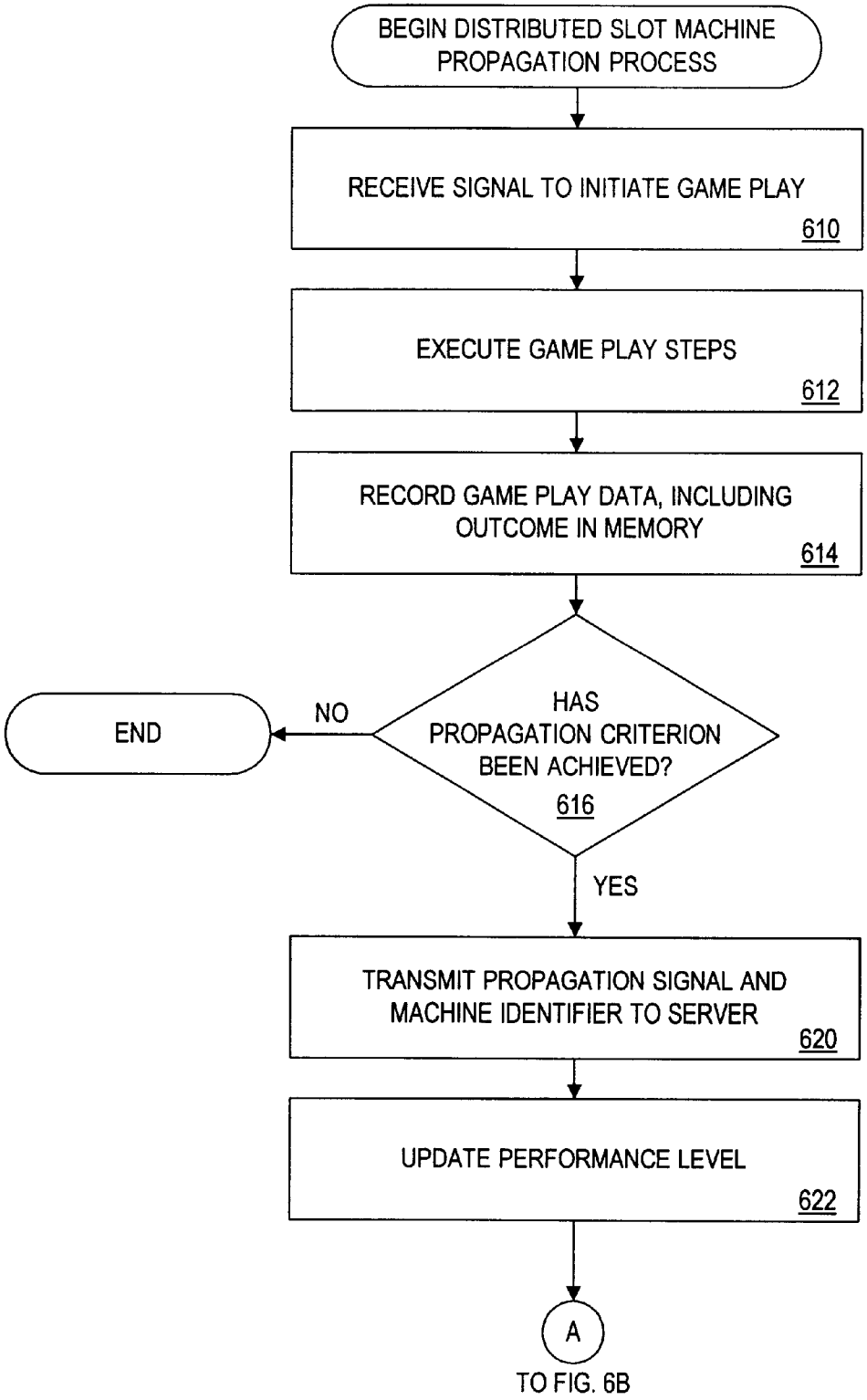
FIGS. 6A–6B together comprise a flowchart illustrating a method for directing a slot machine to cause a performance adjustment signal to the propagated in accordance with a first embodiment of the present invention employing distributed processing.
Figure 6B:
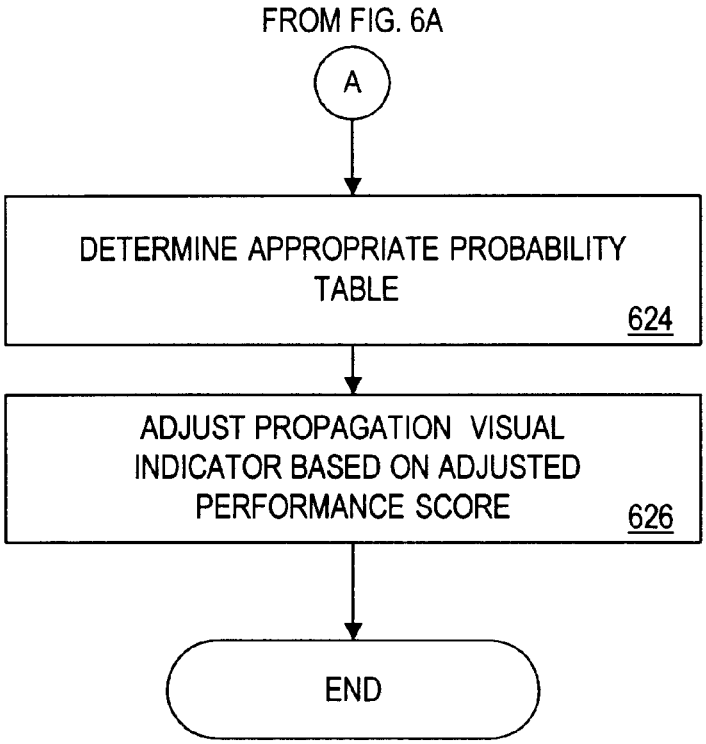
Figure 7:
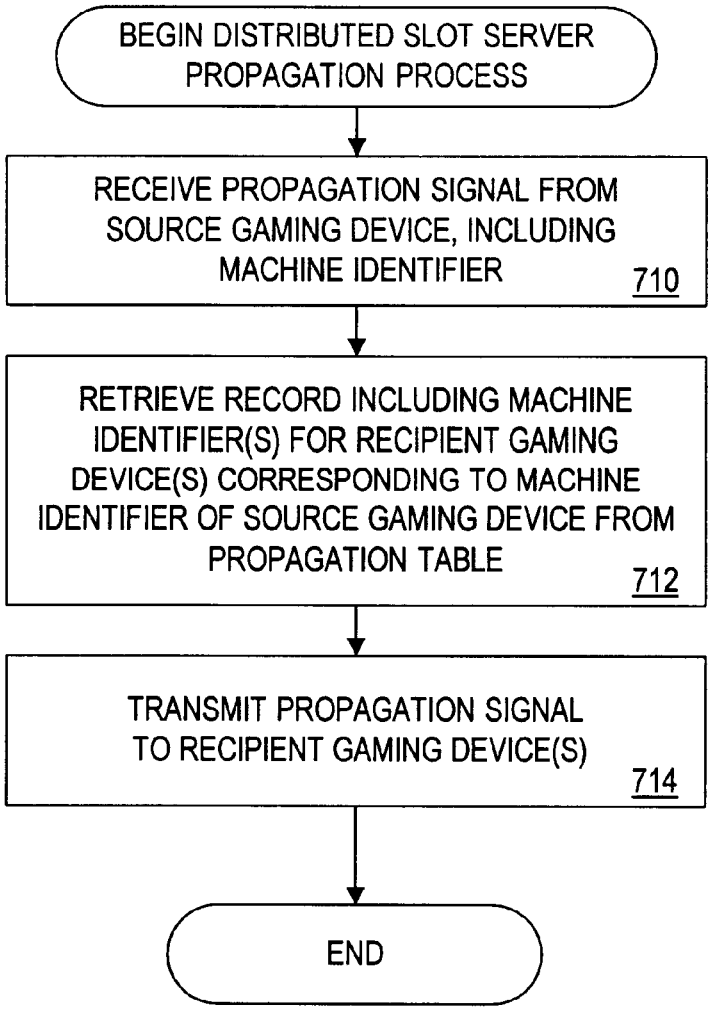
FIG. 7 is a flowchart illustrating a method for a slot server to process and propagate a performance adjustment signal in accordance with a first embodiment of the present invention employing distributed processing.
Figure 8:
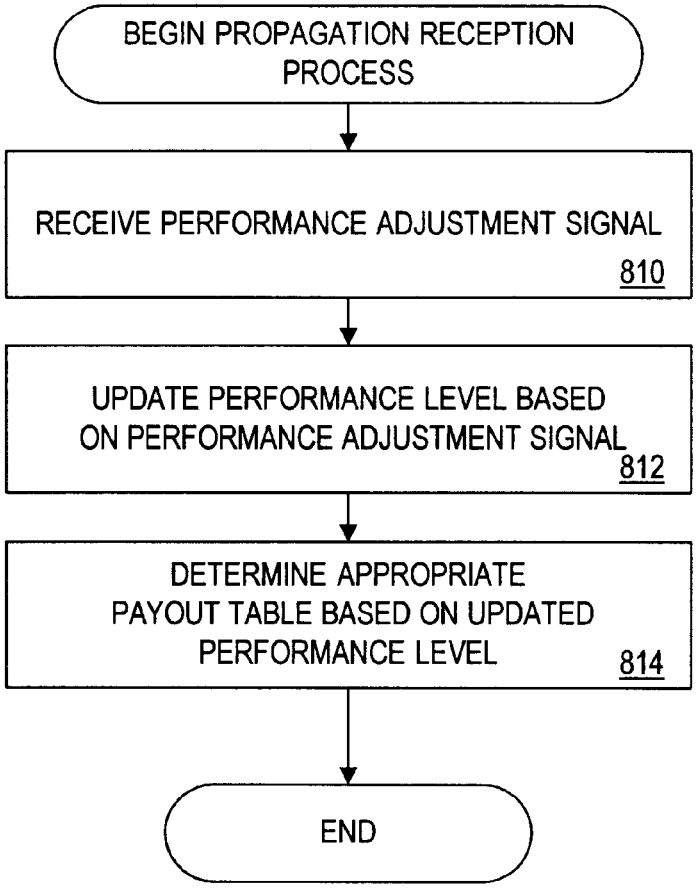
FIG. 8 is a flowchart illustrating a method for a recipient slot machine to process a performance adjustment signal in accordance with the present invention.

Having thus described the architecture and components of the slot network of the preferred embodiment, the operation of the apparatus will now be described in greater detail with reference to FIGS. 6A–8. FIGS. 6A and 6B together comprise a flowchart illustrating an exemplary propagation process executed by a source slot machine in an embodiment employing distributed processing. FIG. 7 is a flowchart illustrating an exemplary propagation process executed by a slot server in an embodiment employing distributed processing. FIG. 8 is a flowchart illustrating an exemplary propagation reception process.

These flowcharts describe a preferred embodiment in which an intelligent slot machine, such as slot machine 204, determines whether a propagation criterion has been achieved and notifies slot server 300. Slot server 300 propagates a performance adjustment by identifying recipient slot machines associated with slot machine 204 and transmits a performance adjustment signal to the identified recipient slot machines.

Referring now to FIGS. 6A and 6B, an exemplary distributed slot machine propagation process is illustrated in the form of a flowchart. The propagation process enables a source slot machine to notify slot server 300 when a propagation criterion has been achieved. At block 610, processor 210 receives a signal to initiate game play. At block 612, processor 210 executes game play steps, in conjunction with certain operating system and control software, necessary to facilitate the game offered by slot machine 204.

Game play data, including a game outcome, is stored in memory by processor 210 at block 614. The game play data is used, at least in part, at block 616 to determine whether a predetermined propagation criterion has been achieved. Examples of the propagation criteria that warrant an increase in a performance level of a slot machine include, for example, paying out over 1000 coins within the last 24 hours, paying out a progressive jackpot, and paying out coins for outcomes eighty of the last one hundred handle pulls. Of course, the propagation criteria may also represent performance associated with reducing a performance level. Such propagation criteria are associated with a "cooling off" of a slot machine, and include, for example, 20 spins since the last positive performance adjustment, five minutes of elapsed time since the last positive performance adjustment, or 10 losing plays since the last positive performance adjustment.

The propagation criteria may be incorporated in the control logic of program 216 or may be stored as a data table. The propagation criteria may further include a performance adjustment value. If a propagation criterion has not been achieved, processor 210 discontinues processing, otherwise processor 210 continues executing process steps at block 620.

At block 620, processor 210 transmits a propagation signal to server 300 indicating that a performance adjustment is appropriate for all recipient slot machines associated with source slot machine 204. Processor 210 updates the performance level of slot machine 204 to reflect the performance adjustment, as shown by block 622. Program 216 utilizes the adjusted performance level to control the performance of the slot machine during subsequent play. Each possible value of the performance level may affect the slot machine in any number of ways. The value of the performance level may determine, for example, which of a set of probability tables program 216 should reference when generating game outcomes, or which of a set of payout tables program 216 should reference when awarding a payout.

In the preferred embodiment, the value of the performance level determines which of a set of probability tables program 216 references when generating an outcome. At block 624, the appropriate probability table is determined by processor 210 based on the updated performance level. At block 626, processor 210 adjusts the output of propagation indicator 250 to reflect the updated performance level.

The purpose of propagation indicator 250 is to graphically represent the performance level of the slot machine. Propagation indicator 250 may be any indicator capable of conveying a value. For example, propagation indicator 250 may be a set of yellow, orange and red lights, with each light corresponding to a different performance level (e.g. yellow represents a performance level of one, orange represents a performance level of two, and red represents a performance level of three). As the performance level is increased, propagation indicator 250 is updated to reflect the change.

It should be noted that propagation indicator 250 is not limited to a light display. Propagation indicator 250 may be a device which produces varying amounts of steam based on the performance level of the associated slot machine, representing how "hot" the slot machine is. Propagation indicator 250 may include an audio device, or may include an external indicator, such as a lighting panel embedded in the floor beneath the machine or a spotlight which highlights the machine. Propagation indicator 250 may even be a device, such as a hydraulic lift, which physically changes the appearance of the machine, as by increasing the apparent height of the machine.

Referring now to FIG. 7, an exemplary slot server propagation process is illustrated in the form of a flowchart. Slot server 300 performs the illustrated propagation process to propagate a performance adjustment signal to a set of related slot machines. At block 710, slot server 300 receives a propagation signal from a source gaming device, such as slot machine 204. The performance adjustment signal preferably includes the machine identifier of the source slot machine, and represents a request to adjust the performance levels of all associated recipient slot machines.

At block 712, server 300 retrieves at least one record from propagation table 400. The retrieved record includes recipient machine identifiers corresponding to recipient gaming devices associated with the source gaming device. Server 300 transmits a performance adjustment signal to each of the recipient gaming devices, thereby propagating the performance adjustment to all gaming devices associated with the source gaming device.

Referring now to FIG. 8, there are illustrated the steps of an exemplary propagation reception process executed by a recipient slot machine, such as slot machine 202. At block 810, slot machine 202 receives a performance adjustment signal from server 300. Slot machine 202 updates performance level 218 stored in storage device 214 based on the received performance adjustment signal, as shown by block 812. At block 814, slot machine 202 determines the appropriate payout table based on the updated performance level.

In an alternate embodiment, the propagation reception process may include a step of determining whether the recipient slot machine is presently in use by a player. This may be accomplished using sensors, by determining whether a player tracking card is inserted into card reader 218 or by checking the number of electronic credits at the recipient machine. Such a determination would prevent idle players from merely waiting for the performance level of a recipient machine to increase before playing the machine.

In a further alternate embodiment, server 300 may be responsive to a command to increase or decrease the performance level of one or more specific recipient slot machines. In this way, the casino could artificially create a "hot spot" within the casino to encourage players to play in a specific area of the casino. This enables the casino to control or affect traffic patterns within the casino, thereby directing traffic to high maximum wager machines, high house advantage machines or machines which are under utilized.

Figure 9:
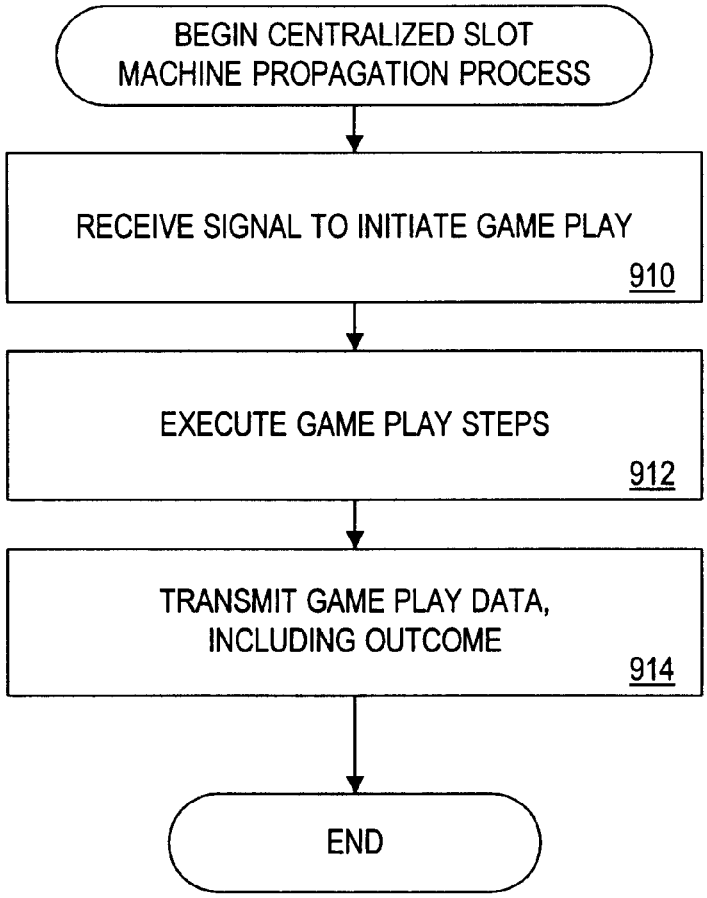
FIG. 9 is a flowchart illustrating a method for directing a slot machine to provide game play data to a slot server in accordance with a second embodiment of the present invention employing centralized processing.
Figure 10:
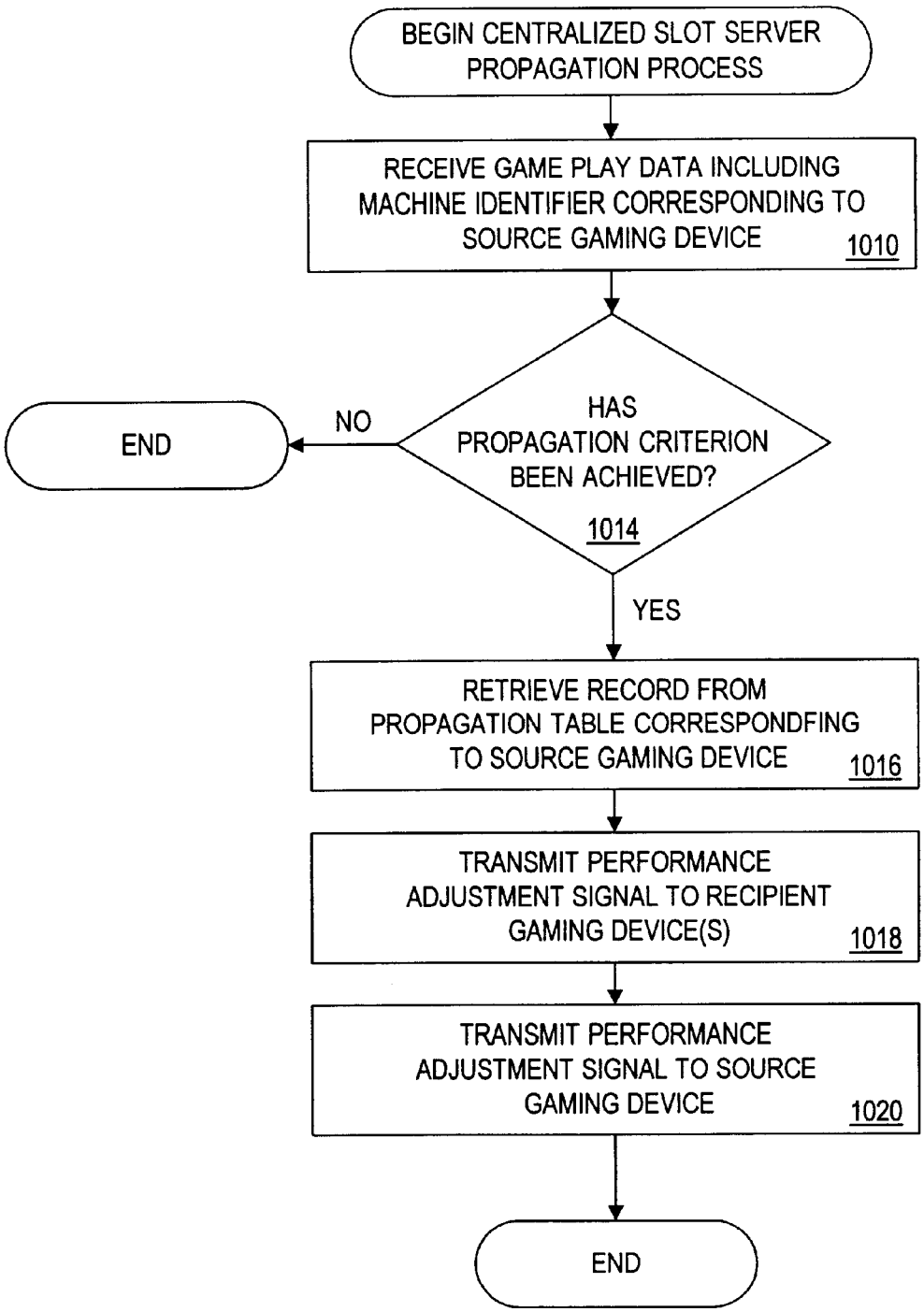
FIG. 10 is a flowchart illustrating an alternate method for a slot server to propagate a performance adjustment signal in accordance with a second embodiment of the present invention employing centralized processing.

The flowcharts of FIGS. 9 and 10 describe an alternate embodiment in which much of the processing required to identify and propagate performance adjustments is accomplished by server 300. FIG. 9 is a flowchart illustrating an exemplary propagation process executed by an unintelligent slot machine 204. FIG. 10 is a flowchart illustrating an exemplary propagation process executed by a slot server.

Referring now to FIG. 9, at block 910, processor 210 receives a signal to initiate game play. At block 912, processor 210 executes game play steps associated with the game offered by slot machine 204. Game play data, including a game outcome, is transmitted to server 300 at block 914. As illustrated by FIG. 10, server 300 determines whether a performance adjustment is warranted, and propagates a performance adjustment signal accordingly.

Referring now to FIG. 10, there is illustrated an alternate slot server propagation process. At block 1010, server 300 receives game play data, preferably including a machine identifier, from source slot machine 204. The game play data is used at block 1012 to determine whether a predetermined propagation criterion has been achieved. If a propagation criterion has not been achieved, processor 302 discontinues processing, otherwise processor 302 continues executing process steps at block 1016.

At block 1016, server 300 retrieves at least one record from propagation table 400. The retrieved record includes recipient machine identifiers corresponding to recipient gaming devices 203 and 205 associated with the source gaming device. At block 1018, server 300 transmits a performance adjustment signal to each of the recipient gaming devices, thereby propagating the performance adjustment to all gaming devices associated with the source gaming device. Server 300 further transmits a performance adjustment signal to source gaming device 204, as illustrated by block 1020, to cause the performance level of source gaming device 204 to be adjusted accordingly.

Alternate Embodiments

Many variations of the present invention are possible. For example, instead of receiving propagation signals which cause an incremental adjustment of the performance level of a recipient machine, the recipient machine may receive a propagation signal which indicates the performance level itself. In other words, rather that receiving a signal from the server indicating the performance level of the recipient machine should be increased or decreased by a particular value, a recipient machine may receive a signal including data representing an updated performance level. This alternate embodiment would enable server 300 to define the performance level of every machine, based on certain criteria. For example, server 300 may set performance levels of networked machines based on an average of the performance levels of neighboring machines.

Another variation of the present invention includes storing a performance level on a player tracking card at the end of a player's session and reading a performance level from a player tracking card at the beginning of a subsequent session. By storing a performance level on a player tracking card, a player may retain a high performance level which may be read by a slot machine at the beginning of a player's next session. This variation enables a player to select a "cold" slot machine to play and cause it to be as "hot" as the last slot machine he played. Optionally, this feature may cause the surrounding machines to adjust their performance level.

Yet another variation of the present invention includes causing a performance adjustment based on circumstances other than the achievement of a propagation criterion. For example, server 300 may be programmed to enable casino personnel to increase the performance level of selected slot machines in the casino to encourage players to play the selected slot machines. Such slot machines, for example, may be selected based on any factor including traffic patterns within the casino and profitability of the selected slot machines. Other examples of causing a performance adjustment based on circumstances other than the achievement of a propagation criterion include improving the performance level of a slot machine in response to payment by a player and improving the performance level of a slot machine based on a player's rate of play.

ILLUSTRATIVE EXAMPLE

Figure 11A:
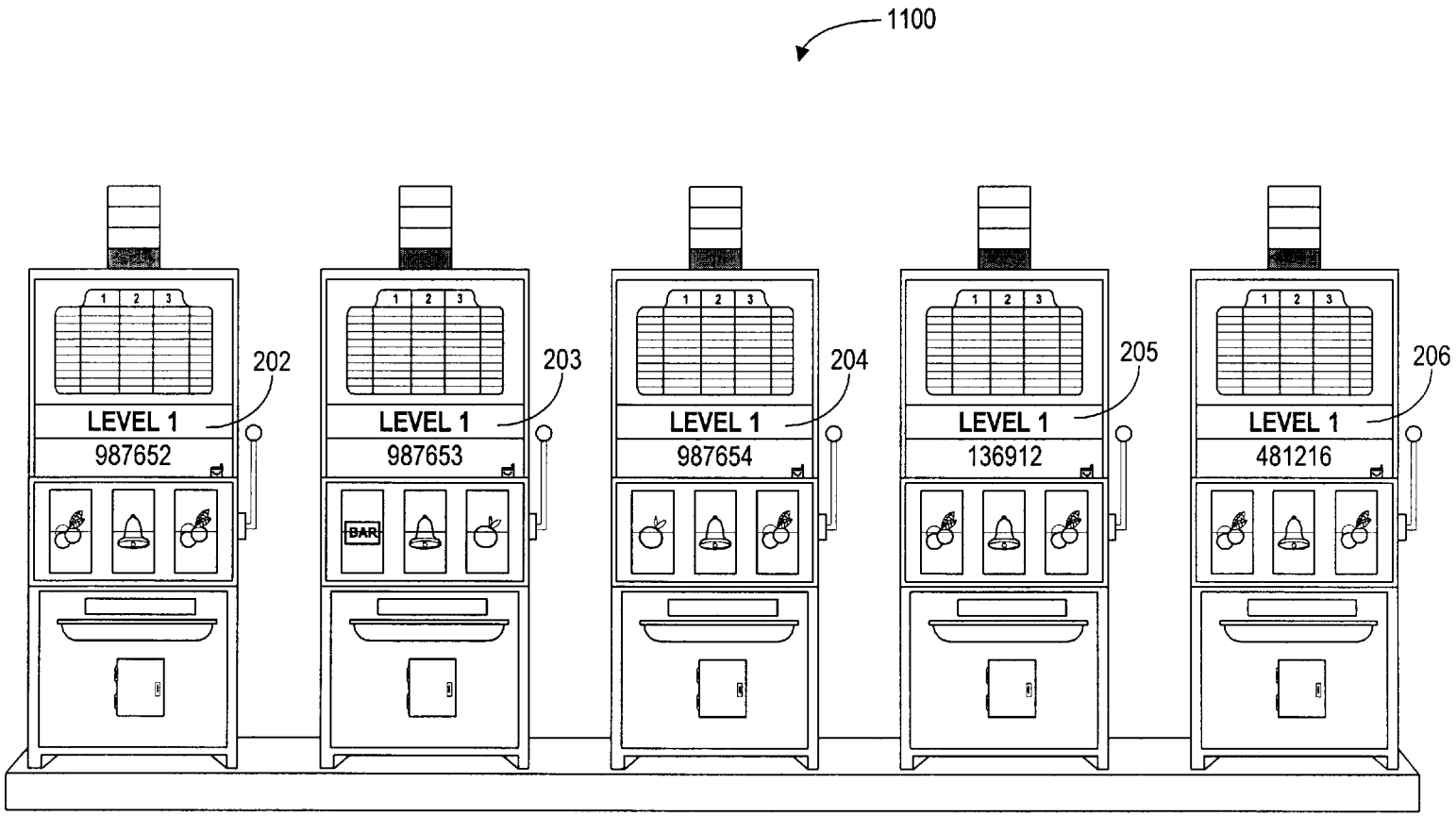
FIGS. 11A–11D are schematic diagrams of a bane of slot machines employing the present invention.

An illustrative example of the operation of the present invention will now be discussed with reference to FIGS. 11A–11D. In FIG. 11A, there is depicted a bank of slot machines 1100. Each of slot machines 202, 203, 204, 205 and 206 is shown to be operating at a performance level of "1", the base or normal performance level. According to the present invention, if one of the slot machines of bank 1100 achieved a propagation criterion, the performance levels of that slot machine and the neighboring slot machines would increase.

Figure 11B:
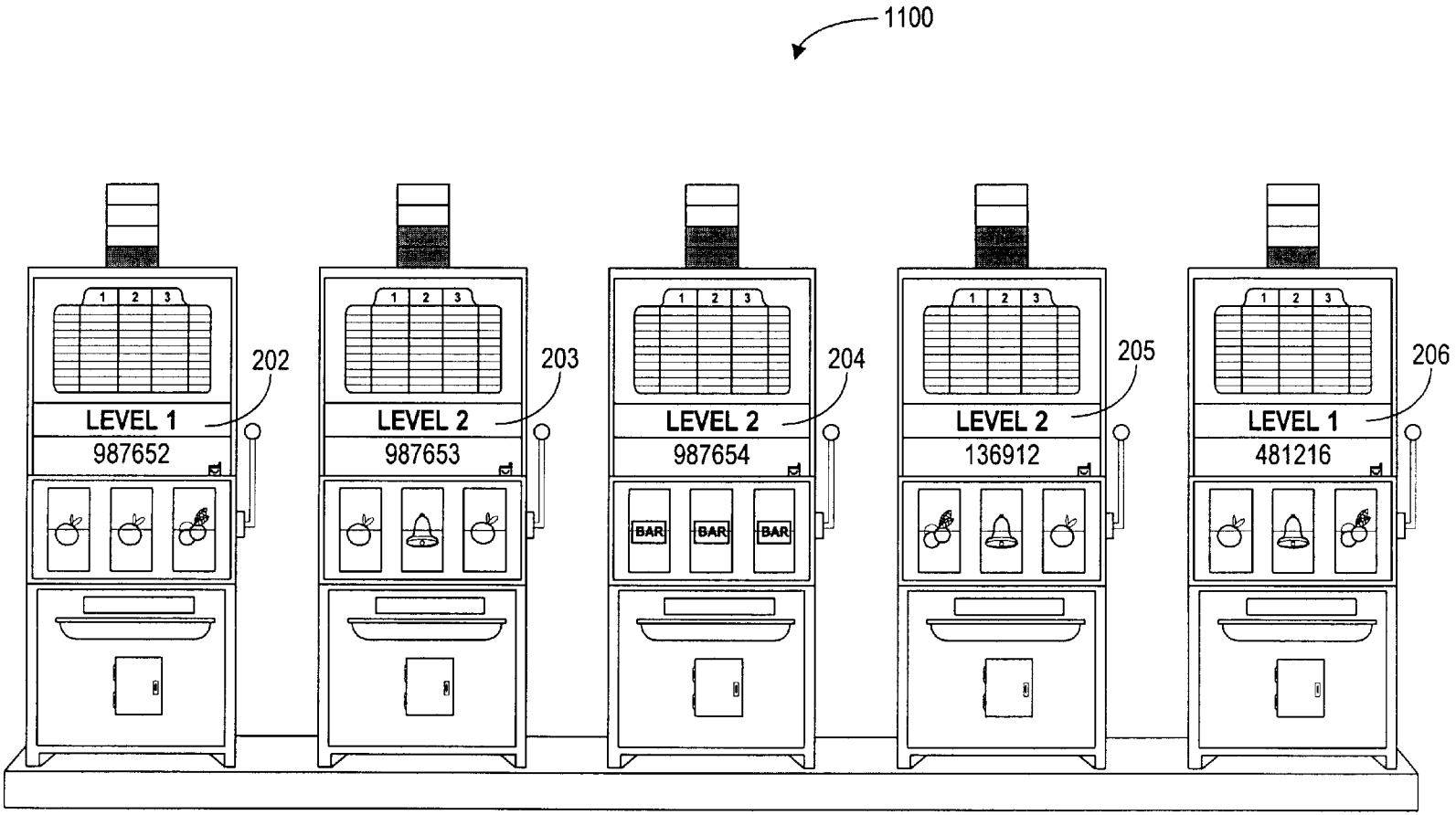

Assume that slot machine 204 generates a jackpot outcome that is a predetermined propagation criterion. Upon determining that the propagation criterion has been achieved, slot machine 204 transmits a propagation signal to slot server 300 (not shown in FIGS. 11A–11D). Server 300 determines the identifiers of slot machines 203 and 205, "987653" and "136912", respectively, using "987654" as an index into propagation table 400. Based on the retrieved machine identifiers, server 300 transmits a performance adjustment signal, representing a performance increase of one, to recipient slot machines 203 and 205. Each of slot machines 203, 204 and 205 increases its associated performance level to "2," and adjusts its propagation indicator 250 to reflect the adjusted performance level. FIG. 11B illustrates the state of the slot machines of bank 1100 after the aforementioned processing.

Figure 11C:
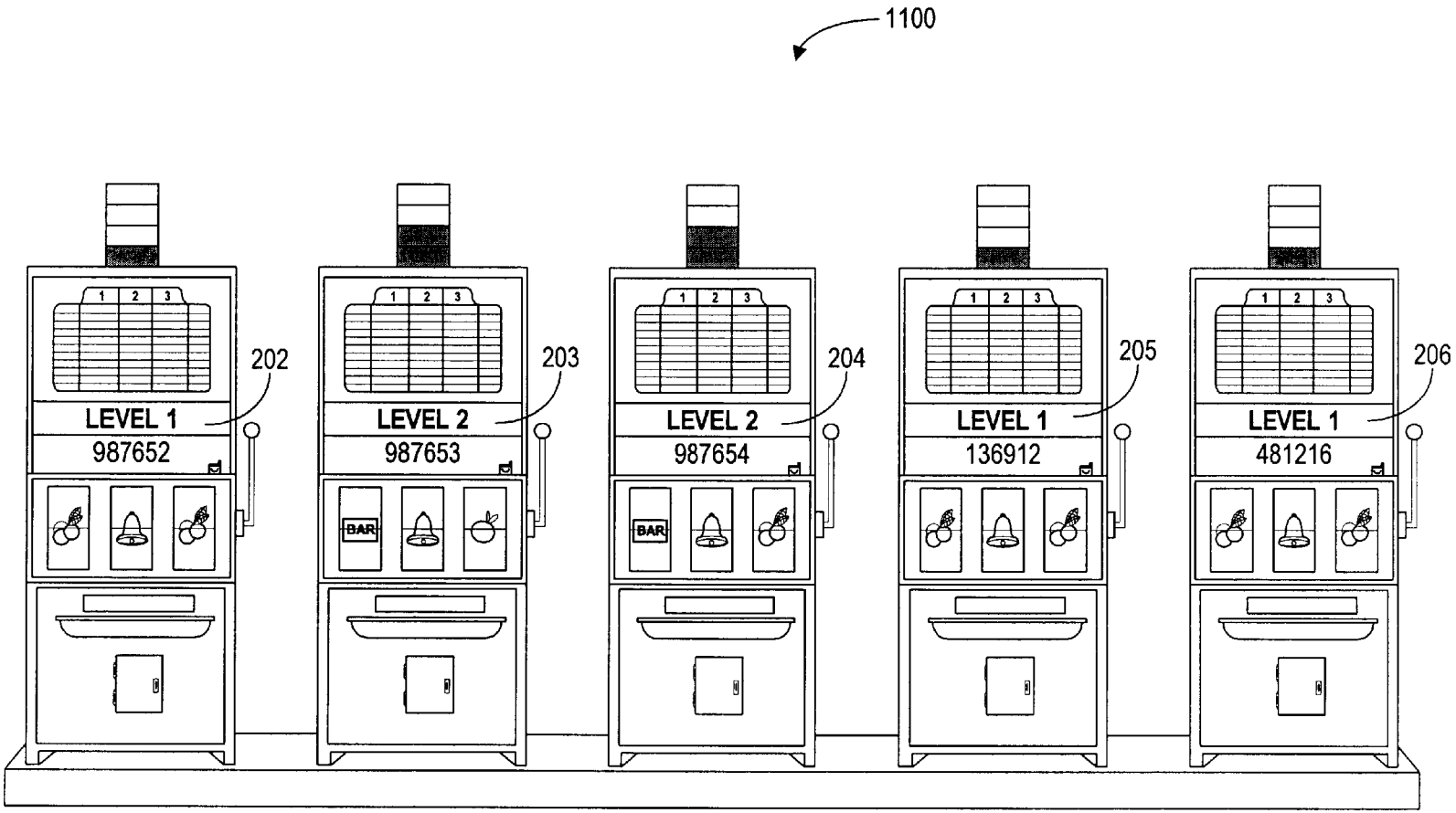

Referring now to FIG. 11C, there is illustrated the state of the slot machines of bank 1100 after slot machine 205 processes a negative performance adjustment. Such a negative performance adjustment may be the result of a slot machine achieving a propagation criterion (affecting neighboring slot machines) or may be the result of programming intended to cause a slot machine's performance to deteriorate over time (affecting only the programmed slot machine). As shown by FIG. 11C, the performance level of slot machine 205 has been adjusted from "2" to "1".

Figure 11D:
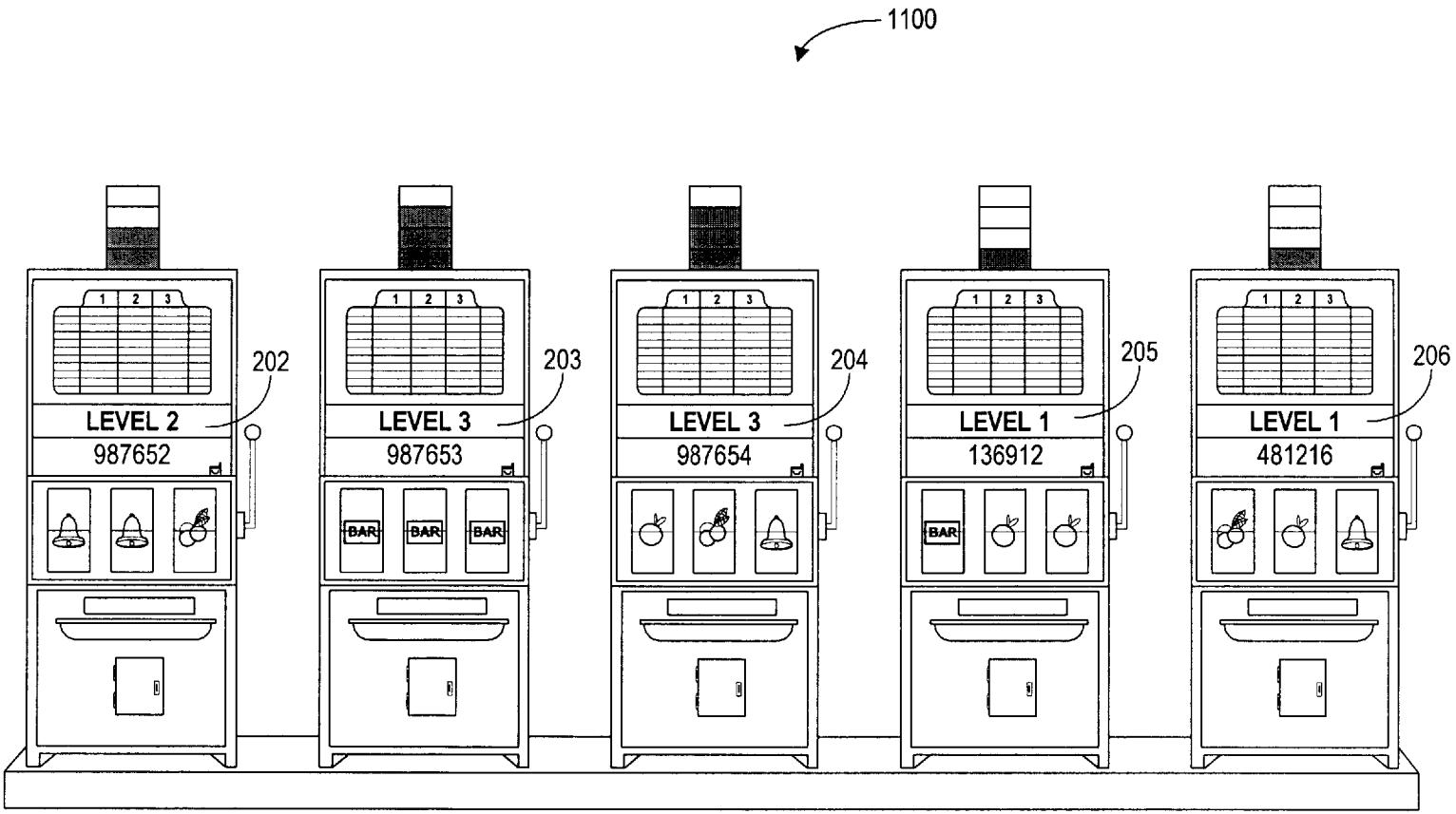

Referring now to FIG. 11D, there is illustrated the state of the slot machines of bank 1100 after slot machines 202, 203 and 204 have processed a performance adjustment signal. Specifically, FIG. 11D reflects the state of slot machine 203 after achieving a propagation criterion and processing a performance level adjustment. FIG. 11D also reflects the state of slot machines 202 and 204 after receiving a propagation signal from server 300 and processing a performance level adjustment.

FIGS. 11A–11D illustrate that each of the networked slot machines 202–206 may be both a source slot machine and a recipient slot machine. This enables the hot spots to move around the casino floor, thereby encouraging traffic throughout the casino.

Figure 12A:
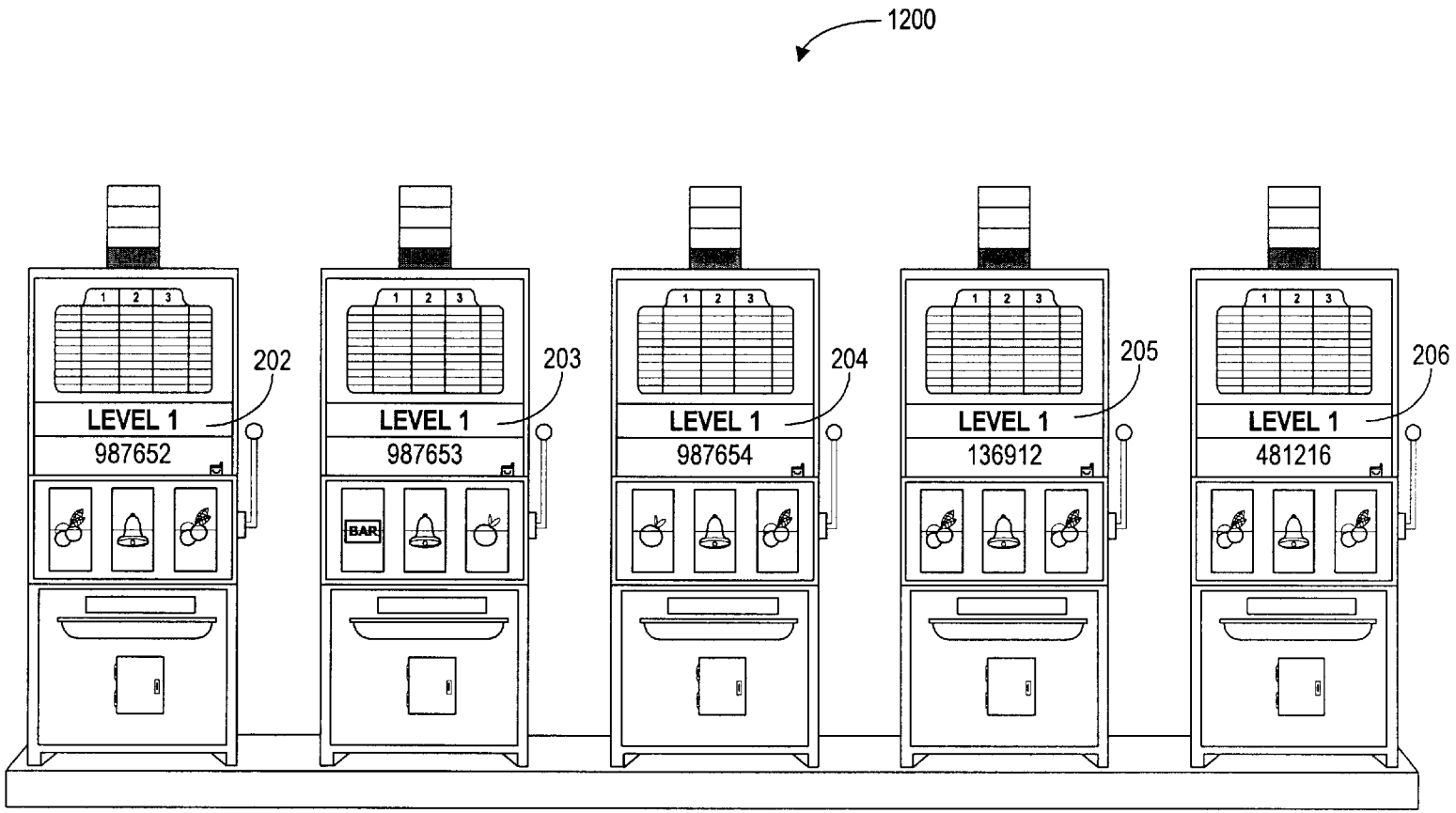
FIGS. 12A and 12B are schematic diagrams of a bank of slot machines employing an alternate embodiment of the present invention.
Figure 12B:
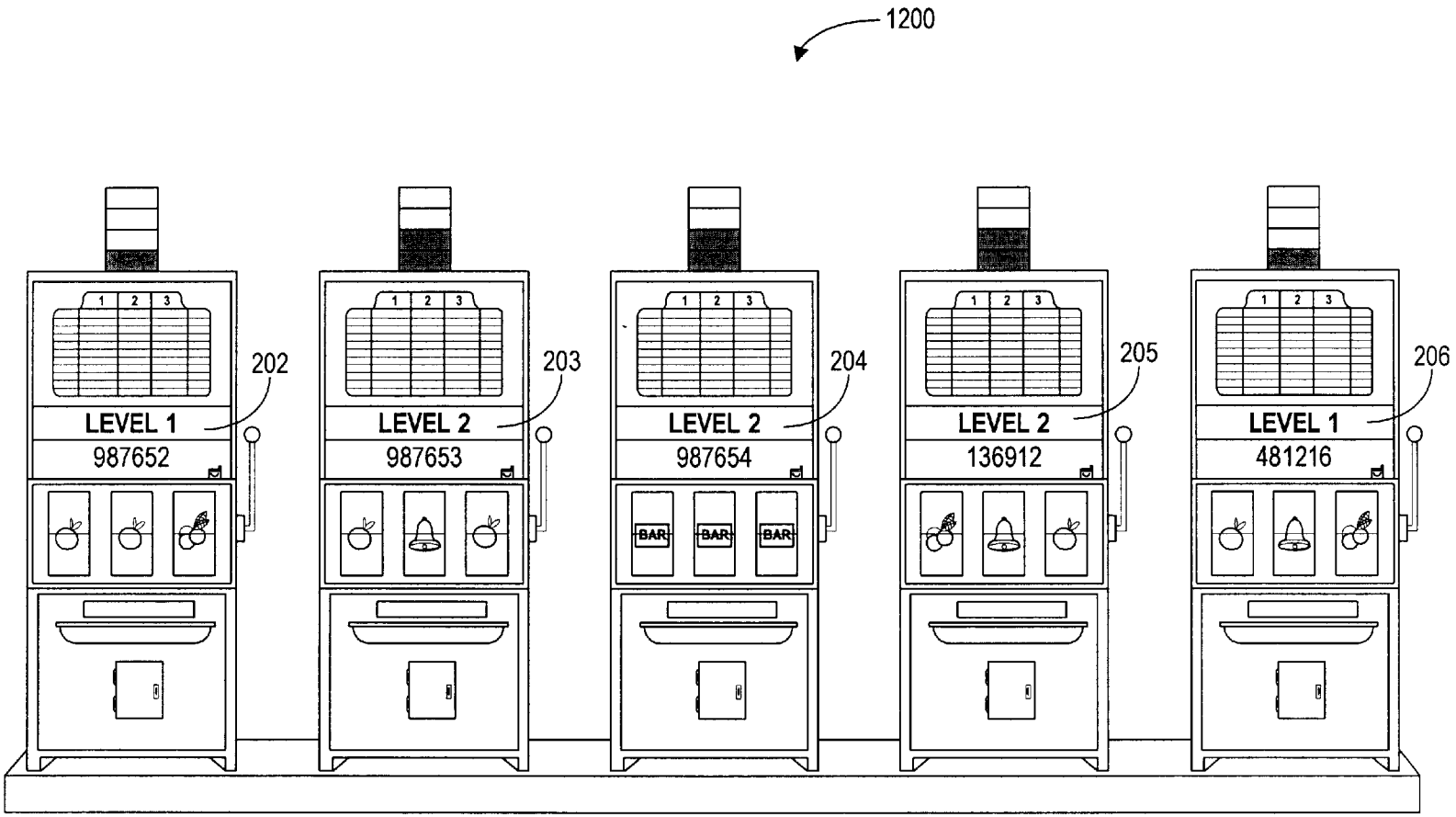

An alternate embodiment of the present invention is illustrated by FIGS. 12A and 12B. In FIG. 12A, a bank of slot machines 202–206 are shown. Each slot machine is operating at a performance level of "1". FIG. 12B illustrates the states of slot machines 202–206 after slot machine 204 achieved a propagation criterion and after slot machines 203, 204 and 205 processed performance adjustment signals.

In this alternate embodiment, a source slot machine achieving a propagation criterion increases its performance level more than the neighboring recipient slot machines. As shown, the performance level of slot machine 204 increased from "1" to "3" because it was the source slot machine. The performance levels of recipient slot machines 203 and 205 increased from "1" to "2" because they were the recipient slot machines.

In the alternate embodiment illustrated by FIGS. 12A and 12B, it is recognized that the performance of the source slot machine should improve more than the performance of the recipient slot machines that did not achieve a propagation criterion. In this way, the "luck" radiates outward from the source slot machine. In fact, the luck could radiate to more distant slot machines based on the actual implementation of the invention. In addition, the performance level increase could be determined based on a player's preferred status.

While the best mode for carrying out the invention has been described in detail, those familiar with the art to which the invention relates will recognize various alternative designs and embodiments for practicing the invention. These alternative embodiments are within the scope of the present invention. Accordingly, the scope of the present invention embodies the scope of the claims appended hereto.

What is claimed is:

1. A method for directing a slot machine to process an indication of adjusted performance, the method comprising the steps of:

storing a first performance level;

receiving a propagation signal, the propagation signal being responsive to an adjustment of a second performance level of another slot machine and the propagation signal representing an instruction to adjust performance by at least one of (i) adjusting an amount of at least one payout; (ii) adjusting a frequency of at least one payout; (iii) adjusting a probability of at least one payout; (iv) adjusting a wager amount; and (v) activating certain bonuses; and adjusting the first performance level based on the instruction, thereby determining an adjusted first performance level.

2. The method of claim 1 wherein the step of adjusting includes increasing the first performance level.

3. The method of claim 1 further comprising the step of indicating at least one of the first performance level and the adjusted first performance level.

4. The method of claim 1 further including the steps of:

receiving an initiation signal to initiate a game play; and conducting a game play in response to the initiation signal, wherein the step of adjusting the first performance level is based on the steps of inducting a game play and receiving a propagation signal.

5. The method of claim 1 further including the steps of:

receiving an initiation signal to initiate a game play;

conducting a game play in response to the initiation signal, thereby determining an outcome; and determining a payout amount based on the outcome and at least one of the first performance level and the adjusted first performance level.

6. The method of claim 1 further including the steps of:

receiving an initiation signal to initiate a game play, determining a probability of an outcome based on at least one of the first performance level and the adjusted first performance level; and conducting a game play in response to the initiation signal, thereby determining the outcome in accordance with the probability.

7. The method of claim 1 further including the step of determining a cost of play based on at least one of the performance level and the adjusted first performance level.

8. The method of claim 3, wherein the step of indicating comprises:

displaying an indication of the at least one of the first performance level and the adjusted performance level to a player.

9. The method of claim 1, wherein the step of receiving comprises:

receiving a propagation signal from another slot machine, the propagation signal being responsive to an adjustment of a second performance level oft e other slot machine and the propagation signal representing an instruction to adjust performance by at least one of (i) adjusting an amount of at least one payout; (ii) adjusting a frequency of at least one payout; (iii) adjusting a probability of at least one payout; (iv) adjusting a wager amount; and (v) activating certain bonuses.

10. The method of claim 1, wherein the step of receiving comprises:

receiving a propagation signal from a server, the propagation signal being responsive to an adjustment of a second performance level of another slot machine and the propagation signal representing an instruction to adjust performance by at least one of (i) adjusting an amount of at least one payout; (ii) adjusting a frequency of at least one payout; (iii) adjusting a probability of at least one payout; (iv) adjusting a wager amount; and (v) activating certain bonuses.

11. The method of claim 1, wherein the propagation signal further represents an indication of the adjusted first performance level.

12. The method of claim 1, wherein the propagation signal further represents an indication of a magnitude by which to adjust performance.

13. The method of claim 1, wherein the step of adjusting comprises:

adjusting the first performance level based on the instruction by accessing a memory to retrieve the adjusted fir t performance level.

14. The method of claim 1, wherein the first performance level corresponds to a first payout table and the adjusted first performance level corresponds to a second payout table, and further comprising the step of:

utilizing the second payout table to determine a payout for a game play conducted while the adjusted first performance level is in effect.

15. The method of claim 14, further comprising:

displaying an indication of the second payout table.

16. The method of claim 1, wherein the first performance level corresponds to a first probability table and the adjusted first performance level corresponds to a second probability table, and further comprising the step of:

utilizing the second probability table to determine an outcome of a game play conducted while the first adjusted performance level is in effect.

17. An apparatus comprising:

a processor, and a storage device that stores a program for directing the processor;

the processor being operative with the program to:

perform the method of claim 1.

18. A computer readable medium encoded with instructions for directing a processor to:

perform the method of claim 1.

* * * * *